US009561654B2

(12) United States Patent
Lessley et al.

(10) Patent No.: US 9,561,654 B2
(45) Date of Patent: Feb. 7, 2017

(54) LAMINATED NOZZLE WITH THICK PLATE

(71) Applicant: Illinois Tool Works Inc., Glenview, IL (US)

(72) Inventors: Mel Steven Lessley, Villa Hills, KY (US); Edward W. Bolyard, Jr., Old Hickory, TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/881,369

(22) Filed: Oct. 13, 2015

(65) Prior Publication Data

US 2016/0144622 A1 May 26, 2016

Related U.S. Application Data

(60) Provisional application No. 62/084,897, filed on Nov. 26, 2014.

(51) Int. Cl.
*B41J 2/14* (2006.01)
*B05B 7/08* (2006.01)
(Continued)

(52) U.S. Cl.
CPC ..... *B41J 2/1433* (2013.01); *B05B 7/08* (2013.01); *B05B 7/0807* (2013.01); *B05B 7/0876* (2013.01); *B05B 7/0884* (2013.01); *B05C 5/027* (2013.01); *B05C 5/0254* (2013.01); *B05C 9/06* (2013.01); *B05C 11/1036* (2013.01); *B05B 7/0408* (2013.01); *B05B 7/12* (2013.01)

(58) Field of Classification Search
CPC ..... B41J 2/1433; B05B 7/08; B05B 7/0807; B05B 7/0876; B05B 7/0408; B05B 7/0884; B05B 7/12; B05C 5/0254; B05C 5/027; B05C 9/06; B05C 11/1036
See application file for complete search history.

(56) References Cited

U.S. PATENT DOCUMENTS 4,680,595 A * 7/1987 Cruz-Uribe ..... B41J 2/14233 347/40
5,882,573 A 3/1999 Kwok et al.
(Continued)

OTHER PUBLICATIONS

International Search Report and Written Opinion of the International Searching Authority dated Feb. 18, 2016, in PCT/US2015/059438.

*Primary Examiner* — Stephen Meier
*Assistant Examiner* — Alexander D Shenderov
(74) *Attorney, Agent, or Firm* — Levenfeld Pearlstein, LLC

(57) ABSTRACT

A laminated nozzle assembly is provided. The laminated nozzle includes a first end plate having a first fluid inlet and a second fluid inlet, a second end plate, a plurality of nozzle plates positioned and clamped between the first end plate and the second end plate, a first fluid conduit in fluid communication with the first fluid inlet formed in one or more of the nozzle plates, a second fluid conduit in fluid communication with the second fluid inlet formed in one or more of the nozzle plates, a first orifice in fluid communication with the first fluid conduit formed in one of the nozzle plates, and a second orifice in fluid communication with the second fluid conduit formed in the same nozzle plate as the first orifice. The laminated nozzle assembly minimizes the number of nozzle plates and includes no more than eight, and preferably no more than five nozzle plates.

10 Claims, 8 Drawing Sheets

(51) Int. Cl.

| | |
|---|---|
| ***B05C 5/02*** | (2006.01) |
| ***B05C 9/06*** | (2006.01) |
| ***B05C 11/10*** | (2006.01) |
| *B05B 7/04* | (2006.01) |
| *B05B 7/12* | (2006.01) |

(56) References Cited

U.S. PATENT DOCUMENTS

| | | | | |
|---|---|---|---|---|
| 5,902,540 | A | 5/1999 | Kwok | |
| 5,904,298 | A | 5/1999 | Kwok et al. | |
| 6,074,597 | A | 6/2000 | Kwok et al. | |
| 6,197,406 | B1 | 3/2001 | Kwok | |
| 6,200,635 | B1 | 3/2001 | Kwok | |
| 6,375,099 | B1 * | 4/2002 | McGuffey | B05C 5/027 239/124 |
| 6,461,430 | B1 | 10/2002 | Kwok | |
| 6,540,831 | B1 | 4/2003 | Craine et al. | |
| 6,890,167 | B1 | 5/2005 | Kwok et al. | |
| 8,985,485 | B2 | 3/2015 | Budai et al. | |
| 2004/0113992 | A1 * | 6/2004 | Drury | B41J 2/14209 347/68 |
| 2004/0174412 | A1 * | 9/2004 | Ohashi | B41J 2/17526 347/50 |
| 2007/0125877 | A1 | 6/2007 | Zillig et al. | |
| 2012/0121803 | A1 | 5/2012 | Pahl et al. | |
| 2013/0192520 | A1 | 8/2013 | Burmester et al. | |
| 2013/0215197 | A1 * | 8/2013 | Hays | B41J 2/161 347/40 |
| 2015/0202648 | A1 | 7/2015 | Bolyard, Jr. | |

* cited by examiner

LAMINATED NOZZLE WITH THICK PLATE

CROSS-REFERENCE TO RELATED APPLICATION DATA

This application claims the benefit of and priority to provisional U.S. Patent Application Ser. No. 62/084,897, filed Nov. 26, 2014, the disclosure of which is incorporated herein in its entirety.

BACKGROUND

The following description relates to a laminated nozzle assembly having one or more thick plates.

A laminated nozzle assembly may be used to discharge a hot melt adhesive onto a substrate. The substrate may be, for example, a layer of material, such as a nonwoven fabric, or a strand of material, such as an elastic strand to be applied on an article, such as a disposable hygiene product. The laminated nozzle assembly may include one or more first orifices for discharging the hot melt adhesive and one or more second orifices configured to discharge air. The discharged air causes the discharged hot melt adhesive to oscillate or vacillate during application to the substrate.

FIG. 1 shows a partial exploded view of a conventional laminated nozzle assembly 10. Referring to FIG. 1, a conventional laminated nozzle assembly 10 includes a plurality of plates having internal conduits formed therein allowing flow of the hot melt adhesive and air therethrough. FIG. 2 is a plan view of the individual plates forming the conventional laminated nozzle assembly 10. Referring to FIGS. 1 and 2, the conventional laminated nozzle assembly may include eleven plates 12, 14, 16, 18, 20, 22, 24, 26, 28, 30, 32 secured between a first end plate 34 and a second end plate 36. A first internal conduit 38 may be formed through a plurality of the plates for delivering the hot melt adhesive to a first orifice 40. The first conduit 38 is formed by a plurality of aligned openings in the plates. A second internal conduit 42 may also be formed through a plurality of the plates for delivering the air to a second orifice 44. The second conduit 42 is formed by a plurality of aligned openings in the plates.

However, in the conventional laminated nozzle assembly 10, the fluid may collect in various portions of the conduits 38, 42, and in the case of the hot melt adhesive, may lead to plugging of the first conduit. Fluid collection may be the result of narrow or small flow paths, indirect flow paths that cause the velocity of a fluid to be reduced, or excess contact with the sidewalls of a conduit (i.e., the portions of the plates surrounding the openings forming the conduits).

Moreover, when the chemistry and manufacturing of the discharged material (e.g., the adhesive) is not well controlled, contaminants may be present in the material and charring may occur at what are otherwise normal operating temperatures. The existence of contaminants, char products and residue can further exaggerate the plugging of the conduits.

Accordingly, it is desirable to provide a laminated nozzle assembly having an internal conduit or conduits allowing for increased passageway size, higher fluid velocity, and more direct flow paths to the discharge orifices.

SUMMARY

According to one aspect, there is provided a laminated nozzle assembly. The laminated nozzle includes a first end plate having a first fluid inlet and a second fluid inlet, a second end plate, a plurality, but limited number of nozzle plates positioned and clamped between the first end plate and the second end plate, a first fluid conduit in fluid communication with the first fluid inlet formed in one or more of the nozzle plates, a second fluid conduit in fluid communication with the second fluid inlet formed in one or more of the nozzle plates, a first orifice in fluid communication with the first fluid conduit formed in one of the nozzle plates, and a second orifice in fluid communication with the second fluid conduit formed in the same nozzle plate as the first orifice.

In an embodiment, the first and second orifices are coplanar with one another. In an embodiment the laminated nozzle assembly includes less than eight (8) nozzle plates. In an embodiment, the laminated nozzle assembly include five (5) nozzle plates. The nozzle plate can include a plurality of first and second orifices. In an embodiment, at least some of the nozzle plates have a thickness of, for example, about 0.005 to about 1.00 mm and more specifically, may have a range of thickness between about 0.125 to 0.50 mm.

In an embodiment, the laminated nozzle assembly minimizes the number of nozzle plates and includes no more than eight, and preferably no more than five nozzle plates.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
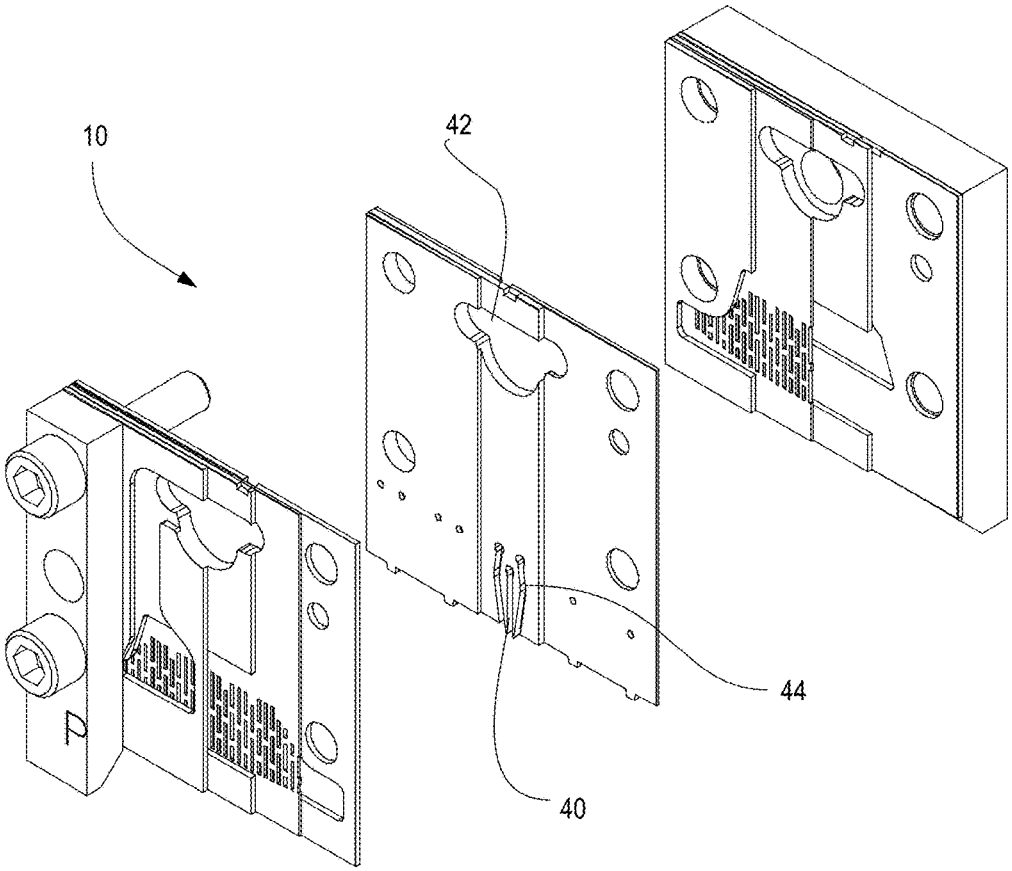
Fig. 1 Prior Art
FIG. 1 is a partial exploded view of a conventional laminated nozzle assembly.
Figure 2:
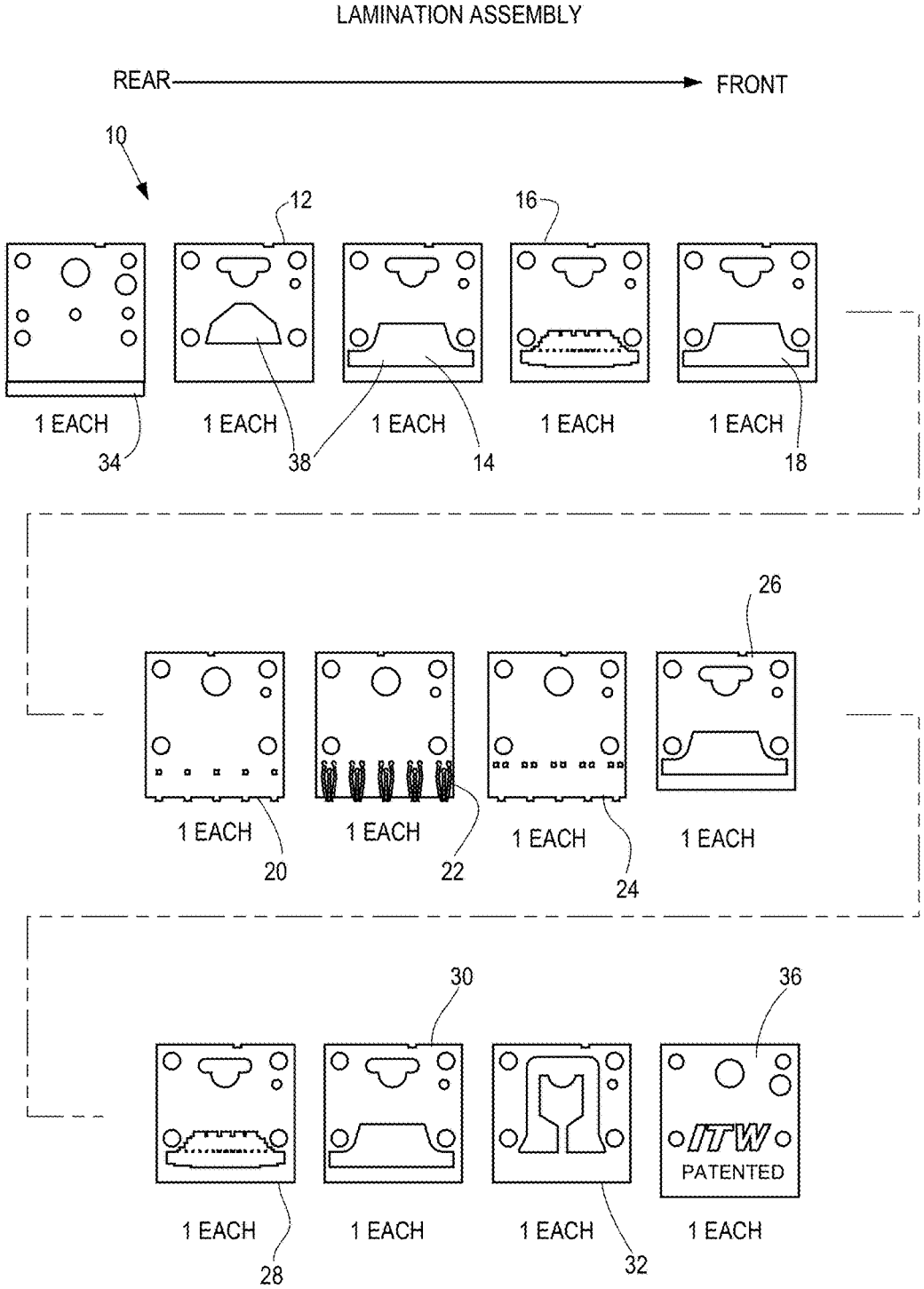
Fig. 2 Prior Art
FIG. 2 is a plan view of the individual plates forming the conventional laminated nozzle assembly of FIG. 1.
Figure 3:
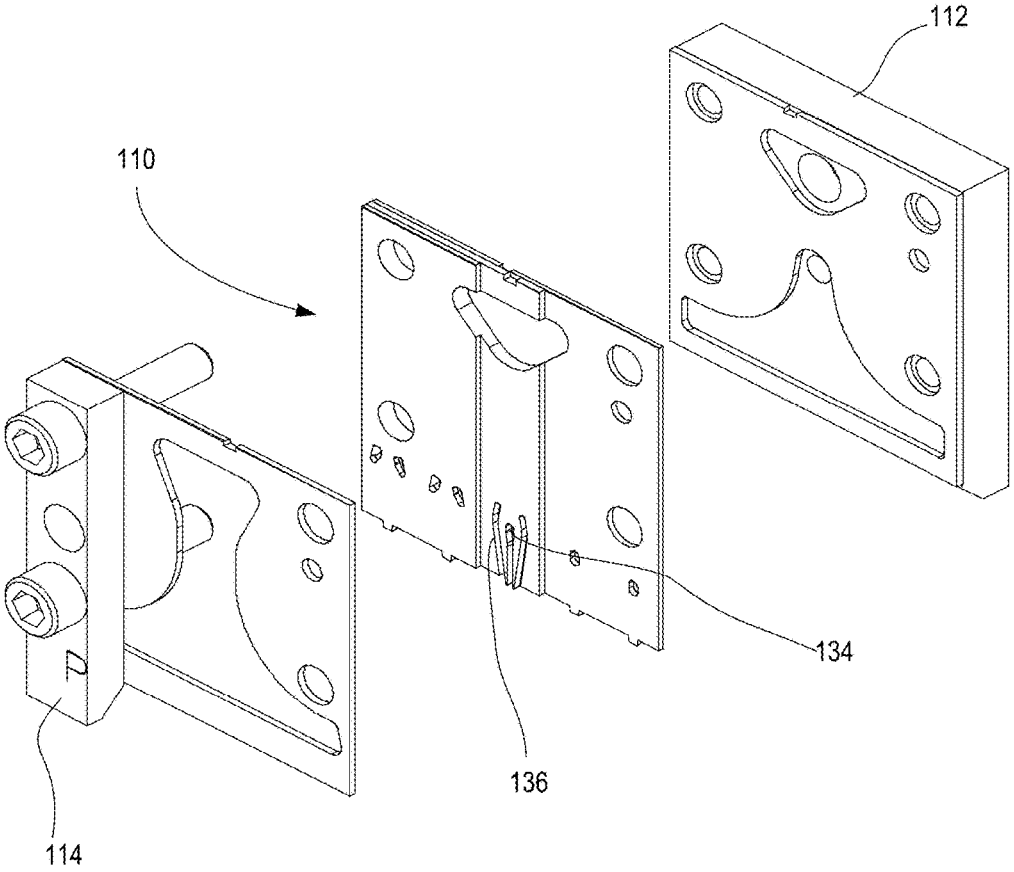
FIG. 3 is a partial exploded view of a laminated nozzle assembly according to one embodiment described herein.
Figure 4:
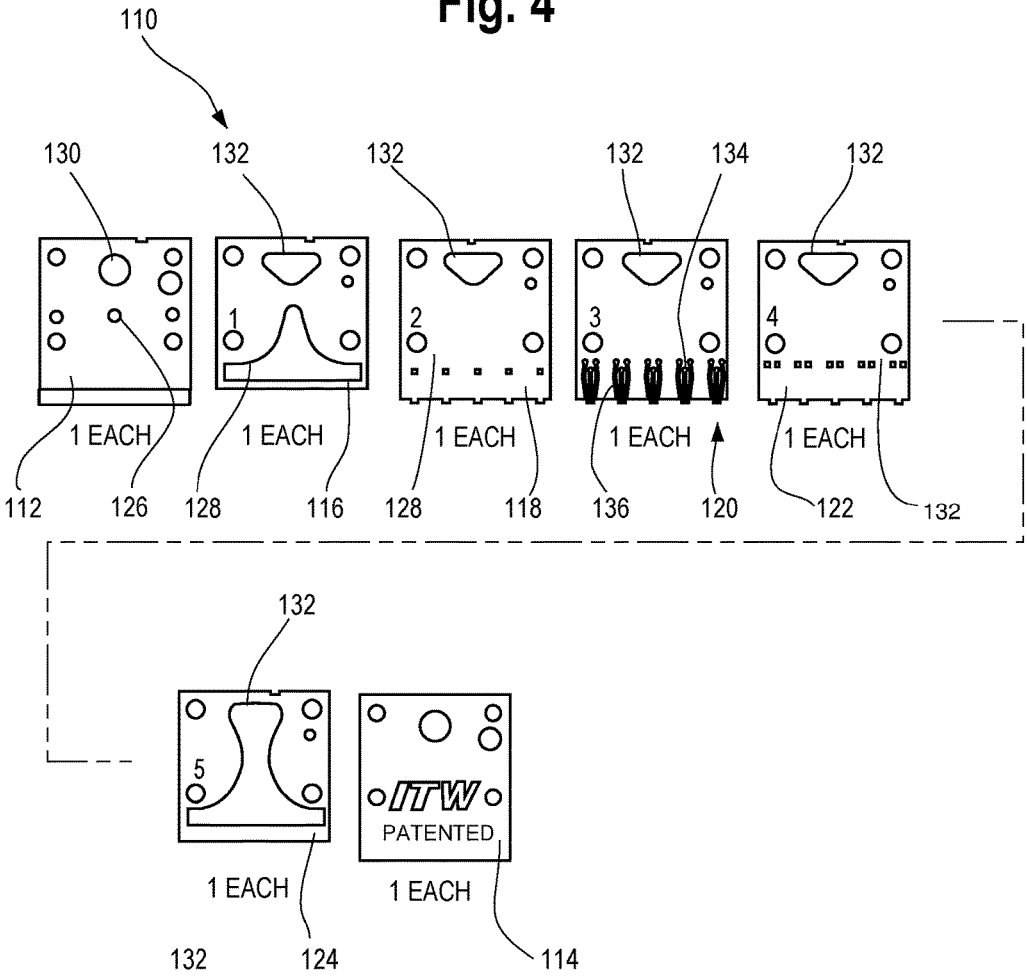
FIG. 4 is a plan view of individual plates forming the laminated nozzle assembly of FIG. 3.

FIG. 3 is a partial exploded view of a laminated nozzle assembly 110 according to one embodiment described herein. FIG. 4 is a plan view of individual plates forming the laminated nozzle assembly of FIG. 3. The laminated nozzle assembly 110 may be formed, for example, with six or fewer nozzle plates positioned between first and second end plates. Referring to FIGS. 3 and 4, in one embodiment, the laminated nozzle assembly 110 may include a first end plate 112, a second end plate 114, and five nozzle plates 116, 118, 120, 122, 124 positioned between the first end plate 112 and the second end plate 114.

Referring to FIG. 4, a first fluid inlet 126 may be formed in the first end plate 112. A first fluid conduit 128 may be formed in one or more of the first end plate 112 and and/or one or more of the nozzle plates 116, 118, 120, 122, 124. In one embodiment, the first fluid conduit 128 is formed in nozzle plates 116, 118. The first fluid conduit 128 may be formed by aligned or partially aligned openings in nozzle plates 116, 118, wherein the opening or openings of the first fluid conduit 128 in one plate are in fluid communication with the opening or openings of the first fluid conduit 128 in an immediately adjacent plate. The first fluid conduit 128 is in fluid communication with the first fluid inlet 128 and is configured to receive the first fluid therefrom. The first fluid may be, for example, a hot melt adhesive, a cold melt adhesive or other fluid ranging from 0 centipoise to 100,000 centipoise. It is understood that the aligned or partially aligned openings forming the first fluid conduit 128 may be of different shape or size than one another so long as the opening or openings in respective plates are in fluid communication with the opening or openings in an immediately adjacent abutting plate.

The first end plate 112 may further include a second fluid inlet 130. The second fluid inlet 130 is in fluid communication with a second fluid conduit 132 formed in one or more nozzle plates 116, 118, 120, 124, 126. Alternatively, at least a portion of the second fluid conduit 132 may be formed in at least one of the first end plate 112 and/or second end plate 114. In one embodiment, as shown in FIG. 4, the second fluid conduit 132 is formed by openings in each of the plates 116, 118, 120, 122, 124. The second fluid conduit 132 is in fluid communication with the second fluid inlet 130 and is configured to receive the second fluid therefrom. In addition, the openings forming the second fluid conduit are aligned or partially aligned with one another and in fluid communication with one another. It is understood that that size and position of the openings forming the second fluid conduit may vary so long as the opening or openings formed in one plate remain in fluid communication with the opening or openings formed in an immediately adjacent abutting plate. The second fluid may be, for example, air.

One plate of the laminated nozzle assembly 110 may include a plurality of orifices for discharging the first and second fluids. In one embodiment, a centrally positioned plate 120 may include one or more first orifices 134 and one or more second orifices 136. It is understood, however, that the first and second orifices 134, 136 may be positioned on another, non-centrally positioned plate of the nozzle assemble 110. The first orifice 134 is in fluid communication with, and is configured to receive the first fluid from the first fluid conduit 128. The second orifice 136 is in fluid communication with, and is configured to receive the second fluid from the second fluid conduit 132. In one embodiment, the first and second orifices 134, 136 lie in a plane that is parallel to the abutting surfaces of the plates of the nozzle assembly 110; that is, as best seen in FIGS. 3, 4 and 5*b*, the first and second orifices 134, 136 are coplanar.

In one embodiment, two second orifices 136 may be associated with each first orifice 134. For example, each first orifice 134 may be positioned between a pair of second orifices 136. Accordingly, two second orifices (one second orifice 136 from adjacent pairs of second orifices 136) may be positioned between adjacent first orifices 134 formed in the same plate 120. However, the present disclosure is not limited to this configuration. For example, a second orifice 136 corresponding to each first orifice 134 may be provided, such that first and second orifices 134, 136 are alternately positioned along the nozzle assembly 110. In such an embodiment the three orifices (two second orifices 136 and one first orifice 134) are coplanar.

In use, according to one embodiment, the first fluid, for example a hot melt adhesive, is received in the first fluid inlet 126. The first fluid may then be received in the first fluid conduit 128. The first fluid may then flow from the first fluid conduit 128 to the one or more first orifices 134 and be discharged from the nozzle assembly 110. The second fluid, for example air, may be received in the second fluid inlet 130 and flow to the second fluid conduit 132. In one embodiment, a flow path in the second conduit 132 may extend in the first direction through the plates 116, 118, 120, 122, 124, in a second direction substantially perpendicular to the first direction, and in the third direction generally opposite to the first direction (that is, flowing back toward plate 120). The one or more second orifices 136 may receive the second fluid from the second conduit to discharge the second fluid from the nozzle assembly 110.

In the embodiments above, the number of plates may vary. It is understood that the number of plates in the nozzle assembly 110 may be reduced by including first and/or second fluid plenums in either of the end plates 112, 114. In one example, the number of plates between end plates 112, 114 may be reduced to three or four.

Figure 5A:
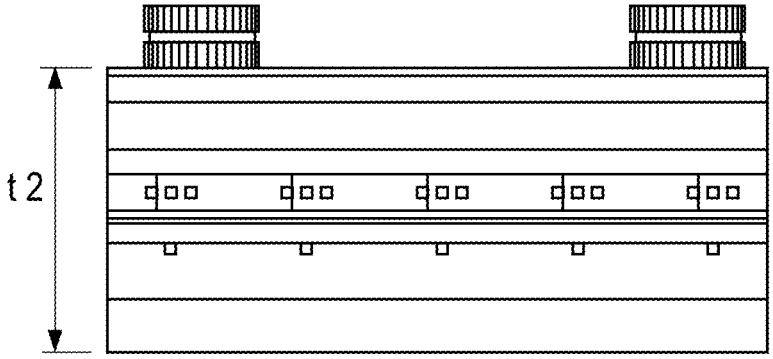
Fig. 5a Prior Art
FIG. 5*a* is a bottom view of the conventional laminated nozzle assembly of FIG. 1.
Figure 5B:
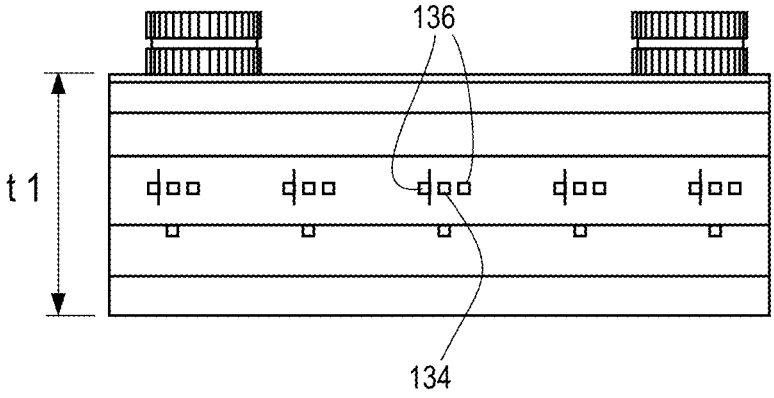
FIG. 5*b* is a bottom view of the laminated nozzle assembly of FIG. 3, according to an embodiment described herein.

FIG. 5*a* is a bottom view of a conventional laminated nozzle assembly 10 and FIG. 5*b* is a bottom view of the laminated nozzle assembly 110 described herein. Referring to FIGS. 5*a* and 5*b*, it may be seen that although a thickness of the individual nozzle plates may be increased in the laminated nozzle assembly 110, an overall thickness 't1' of the nozzle assembly 110 may be reduced compared to the thickness 't2' of the conventional nozzle assembly 10 (FIG. 5*a*) by reducing the number of plates. For example, the conventional nozzle assembly may have a thickness 't2' of about 11.1 mm, while the nozzle assembly 110 described herein may have a thickness of, for example, 9.5 mm.

In one embodiment, the laminated nozzle assembly 110 described herein may operate at temperatures up to about 218 C, and at an air pressure of about 0.3 to 2.1 bar. It is understood, however, that the present description is not limited to these ranges, and that the laminated nozzle assembly 110 described herein may be designed and manufactured to accommodate varying operating temperatures and air pressures. In one embodiment, the individual laminated nozzle plates may have a thickness ranging from 0.005 mm to 1.00 mm, for example and more specifically, may have a range of thickness between about 0.125 to 0.50 mm. It is understood that the thickness of the nozzle plates may vary, and in other embodiments, may be less than 0.005 mm or greater than 1.00 mm.

Figure 6A:
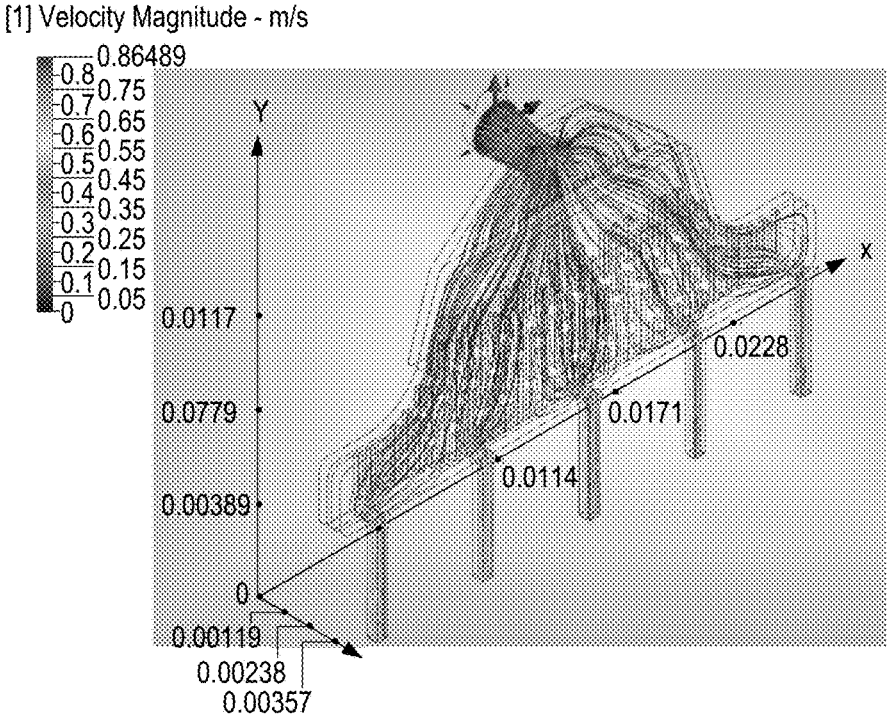
Fig. 6a Prior Art
FIGS. 6*a* and 6*b* are illustrations of a Computational Fluid Dynamic (CFD) model of fluid flow in a conventional laminated nozzle assembly (FIG. 6*a*) and a laminated nozzle assembly according to an embodiment described herein (FIG. 6*b*)
Figure 6B:
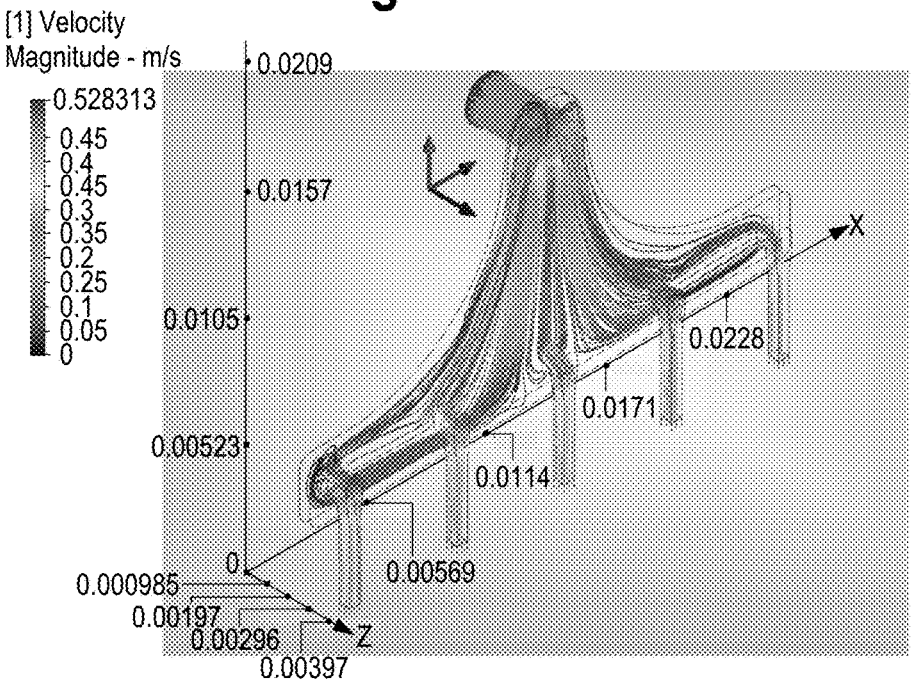
Figure 7A:
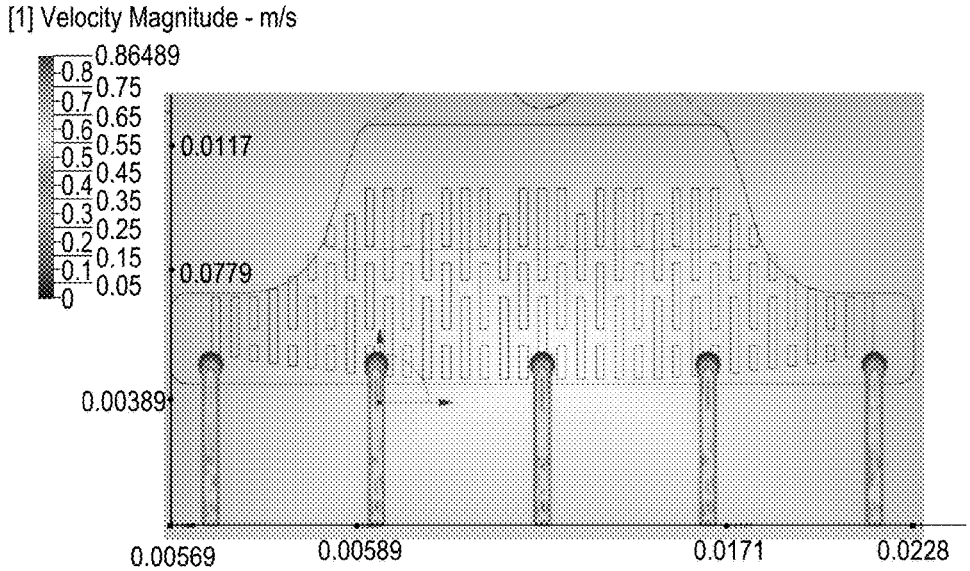
Fig. 7a Prior Art
FIGS. 7*a* and 7*b* are cross-sectional illustrational views of a Computational Fluid Dynamic (CFD) model of fluid flow in a conventional laminated nozzle assembly (FIG. 7*a*) and a laminated nozzle assembly according to an embodiment described herein (FIG. 7*b*)
Figure 7B:
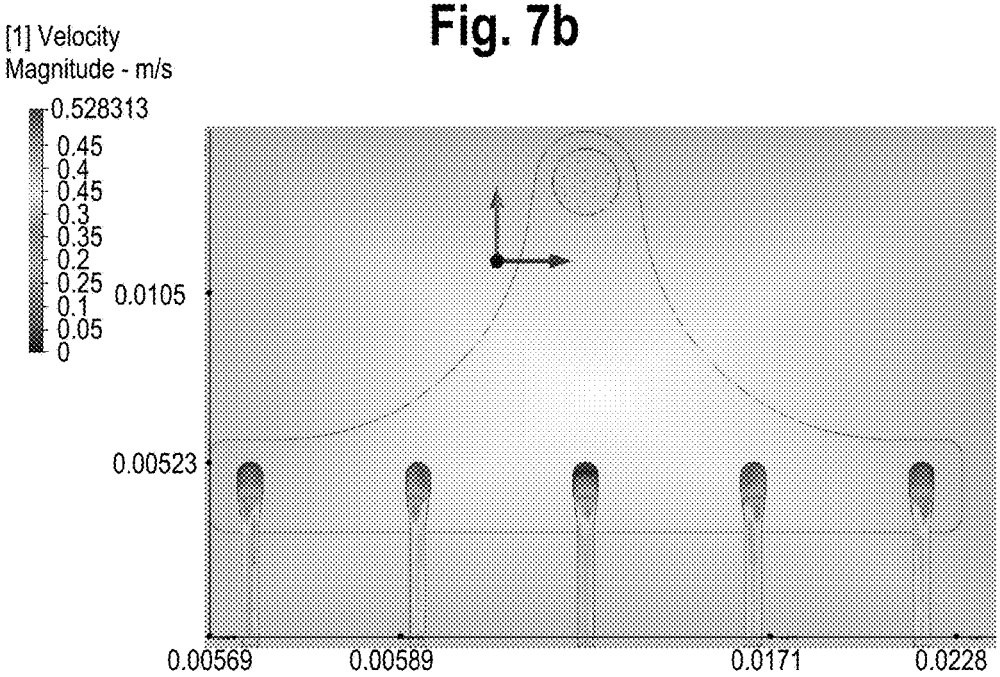
Figure 8A:
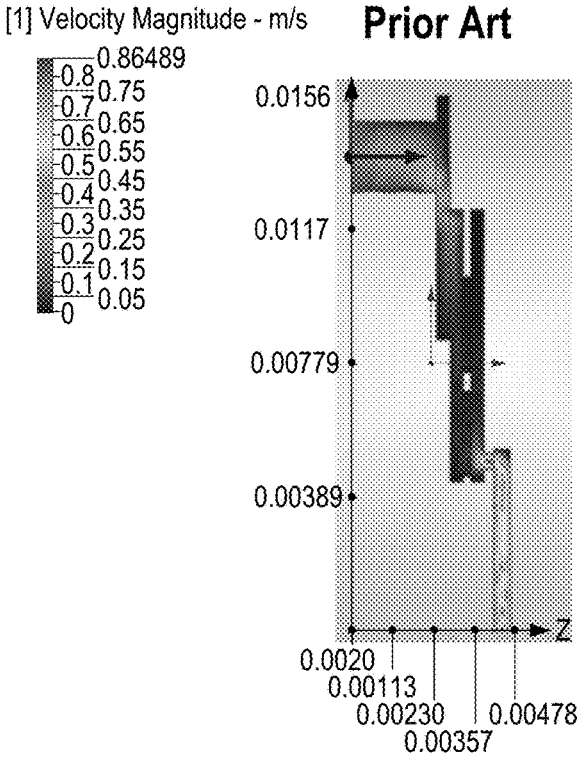
Fig. 8a Prior Art
FIGS. 8*a* and 8*b* are side cross-sectional illustrational views of a Computational Fluid Dynamic (CFD) model of fluid flow in a conventional laminated nozzle assembly (FIG. 8*a*) and a laminated nozzle assembly according to an embodiment described herein (FIG. 8*b*).
Figure 8B:
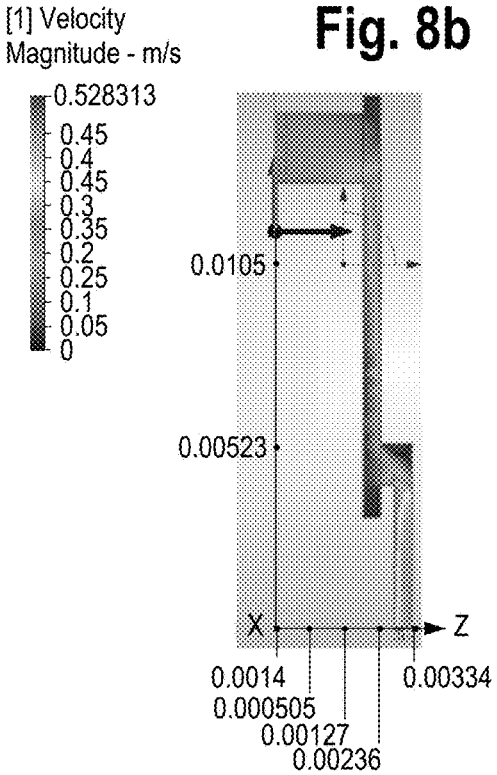

FIGS. 6*a* and 6*b* are perspective views of a Computational Fluid Dynamic (CFD) model of fluid flow in a conventional laminated nozzle 10 assembly (FIG. 6*a*) and a laminated nozzle assembly 110 according to an embodiment described herein (FIG. 6*b*). FIGS. 7*a* and 7*b* are cross-sectional views of a CFD model of fluid flow in a conventional laminated nozzle assembly 10 (FIG. 7*a*) and a laminated nozzle assembly 110 according to an embodiment described herein (FIG. 7*b*). FIGS. 8*a* and 8*b* are side cross-sectional views of a CFD model of fluid flow in a conventional laminated nozzle assembly 10 (FIG. 8*a*) and a laminated nozzle assembly 10 according to an embodiment described herein (FIG. 8*b*).

In the embodiments above, an improved flow path may be provided. For example, when compared to the conventional laminated nozzle assembly 10, higher fluid velocity through nozzle 110 may be realized, especially in a fluid plenum plate (for example, the central plate 120). Orifice entry passages may also be increased in size up to, for example, 50%, thereby improving flow of the first and second fluid through the nozzle assembly 110. Accordingly, nozzle plugging may be reduced, thereby reducing down time of the device. The nozzle assembly 110 described herein may also be easier to clean and maintain, thereby reducing labor requirements. In addition, nozzle lifetime may be increased and a potential to improve processing of polyolefin adhesive chemistries may be realized. Further still, a more direct flow path and more even distribution may be realized. The benefits above may be realized as result of the more direct flow paths in the nozzle assembly 110 described here, resulting in fewer restrictions and/or change of directions in the respective flow paths for the first and second fluids. The laminated nozzle assembly 110 described herein may be implemented in a fluid application device for applying fluid, for example, a hot melt adhesive, on a substrate, including but not limited to a layer of material or a strand of material.

It will be appreciated by those skilled in the art that because of the improved flow path (compared to the conventional laminated nozzle assemblies), the present nozzle assembly may be more forgiving when the chemistry and manufacturing of the adhesive is as well controlled, in that contaminants that may be present in the material and charring that may occur at what are otherwise normal operating temperatures will be less prone to plug flow paths in the conduits.

It will be appreciated by those skilled in the art that the relative directional terms such as upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular. For example, one or more fasteners may be used in the embodiments above.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A laminated nozzle assembly comprising:

a first end plate having a first fluid inlet and a second fluid inlet;

a second end plate;

a plurality of nozzle plates positioned and clamped between the first end plate and the second end plate;

a first fluid conduit in fluid communication with the first fluid inlet formed in one or more of the nozzle plates;

a second fluid conduit in fluid communication with the second fluid inlet formed in one or more of the nozzle plates;

a first orifice formed in one of the nozzle plates of the plurality of nozzle plates between the first and second end plates and disposed in fluid communication with the first fluid conduit for discharging a first fluid from the nozzle assembly, wherein the first orifice is configured to receive the first fluid from the first fluid conduit at a first side of the one nozzle plate; and a second orifice formed in the same one nozzle plate of the plurality of nozzle plates between the first and second end plates as the first orifice and disposed in fluid communication with the second fluid conduit for discharging a second fluid from the nozzle assembly, wherein the second orifice is configured to receive the second fluid from the second fluid conduit at a second side opposite the first side, of the one nozzle plate, wherein the first and second orifices are coplanar.

2. The laminated nozzle assembly of claim 1, wherein the plurality of nozzle plates includes less than eight nozzle plates.

3. The laminated nozzle assembly of claim 1, wherein the plurality of nozzle plates includes no more than five nozzle plates.

4. The laminated nozzle assembly of claim 3, wherein the nozzle assembly includes three nozzle plates.

5. The laminated nozzle assembly of claim 1, including a plurality of first and second orifices.

6. The laminated nozzle assembly of claim 5, wherein the plurality of first and second orifices are coplanar.

7. The laminated nozzle assembly of claim 1, wherein at least some of the plurality of nozzle plates have a thickness of about 0.005 to about 0.500 mm.

8. The laminated nozzle assembly of claim 1, including one or both of first and second fluid plena and wherein the first and/or second fluid plena are in the first and/or second end plates, respectively.

9. The laminated nozzle assembly of claim 8, wherein the nozzle assembly includes three nozzle plates.

10. A laminated nozzle assembly comprising:

a first end plate having a first fluid inlet and a second fluid inlet;

a second end plate;

a plurality of nozzle plates positioned and clamped between the first end plate and the second end plate by way of one or more fasteners extending through the first end plate, second end plate and plurality of nozzle plates;

a first fluid conduit in fluid communication with the first fluid inlet formed in one or more of the nozzle plates;

a second fluid conduit in fluid communication with the second fluid inlet formed in one or more of the nozzle plates;

a first orifice formed in one of the nozzle plates of the plurality of nozzle plates in fluid communication with the first fluid conduit; and a second orifice formed in the same one nozzle plate of the plurality of nozzle plates as the first orifice and disposed in fluid communication with the second fluid conduit, wherein the first and second orifices are coplanar, wherein the plurality of nozzle plates includes no more than five nozzle plates, and wherein the one nozzle plate having the first orifice and second orifice formed therein is a centrally positioned nozzle plate disposed between other nozzle plates of the plurality of nozzle plates.

* * * * *